US009540165B2

(12) United States Patent
Kastha et al.

(10) Patent No.: US 9,540,165 B2
(45) Date of Patent: Jan. 10, 2017

(54) ROLLING BUNDLING MECHANISM FOR AUTOMATIC OPENING AND CLOSING

(71) Applicant: ITC LIMITED, Kolkata, State of West Bengal (IN)

(72) Inventors: Anindya Kastha, Kolkata (IN); Prosun Halder, Kolkata (IN); Ashwani Kumar, Kolkata (IN)

(73) Assignee: ITC LIMITED, Kolkata, State of West Bengal (IN)

( * ) Notice: Subject to any disclaimer, the term of this patent is extended or adjusted under 35 U.S.C. 154(b) by 0 days.

(21) Appl. No.: 14/784,316

(22) PCT Filed: Apr. 11, 2014

(86) PCT No.: PCT/IB2014/060652
§ 371 (c)(1),
(2) Date: Oct. 14, 2015

(87) PCT Pub. No.: WO2014/170809
PCT Pub. Date: Oct. 23, 2014

(65) Prior Publication Data

US 2016/0052701 A1 Feb. 25, 2016

(30) Foreign Application Priority Data

Apr. 17, 2013 (IN) ..... 427/KOL/2013

(51) Int. Cl.
*A24F 15/00* (2006.01)
*B65D 85/10* (2006.01)
(Continued)

(52) U.S. Cl.
CPC ..... *B65D 85/1045* (2013.01); *A24F 15/00* (2013.01); *B65D 5/38* (2013.01)

(58) Field of Classification Search
CPC . B65D 85/10; B65D 85/1027; B65D 85/1009; B65D 85/1036; B65D 85/1045; B65D 5/38; A24F 15/06; A24F 15/16; A24F 15/00
(Continued)

(56) References Cited

U.S. PATENT DOCUMENTS 311,642 A * 2/1885 Butler ..... B65D 85/1009 206/249
1,705,284 A * 3/1929 Enfant ..... B65D 83/00 206/250
(Continued)

FOREIGN PATENT DOCUMENTS

EP 1590251 A2 11/2005
EP 2371739 A1 10/2011

OTHER PUBLICATIONS

International Search Report and Written Opinion for International Patent Application No. PCT/IB2014/060652, mailed Jul. 22, 2014.
(Continued)

*Primary Examiner* — Jacob K Ackun
*Assistant Examiner* — Rafael Ortiz
(74) *Attorney, Agent, or Firm* — Merchant & Gould P.C.

(57) ABSTRACT

The present invention relates generally to a packaging assembly. More particularly the present invention relates to a packet for holding similar and/or dissimilar objects wherein said packet facilitates dispensing of objects when desired and reclosing to secure the said objects. It can be used in applications like a cigarette packet and like containers. This invention provides an advantageous feature of doubly securing the objects in the container.

17 Claims, 6 Drawing Sheets

(51) Int. Cl.
*B65D 85/12* (2006.01)
*B65D 5/38* (2006.01)

(58) Field of Classification Search
USPC ..... 206/264, 250, 247, 242, 265, 751, 769,206/248, 249, 254, 255, 267, 270, 262, 271,206/273, 804
See application file for complete search history.

(56) References Cited

U.S. PATENT DOCUMENTS

| | | | | |
|---|---|---|---|---|
| 2,030,305 | A * | 2/1936 | Koehler | A24F 15/16 206/250 |
| 2,929,542 | A * | 3/1960 | O'Gorman | B65D 5/6688 206/268 |
| 3,363,821 | A * | 1/1968 | Melconian | B65D 5/38 206/267 |
| 8,245,841 | B2 * | 8/2012 | Agirbas | B65D 5/38 206/268 |
| 2012/0261285 | A1 * | 10/2012 | Holloway | B65D 85/1054 206/250 |

OTHER PUBLICATIONS

Second Written Opinion for International Patent Application No. PCT/IB2014/060652, mailed May 5, 2015.
International Preliminary Report on Patentability for International Patent Application No. PCT/IB2014/060652, mailed Aug. 11, 2015.

* cited by examiner

ROLLING BUNDLING MECHANISM FOR AUTOMATIC OPENING AND CLOSING

This application is a National Stage Application of International Application No. PCT/IB2014/060652, filed 11 Apr. 2014, which claims benefit of Serial No. 427/KOL/2013, filed 17 Apr. 2013 in India and which applications are incorporated herein by reference. To the extent appropriate, a claim of priority is made to each of the above disclosed applications.

TECHNICAL FIELD OF THE INVENTION

The present invention relates generally to a packaging assembly. More particularly the present invention relates to a packet for holding similar and/or dissimilar objects wherein said packet facilitates dispensing of objects when desired and reclosing to secure the said objects. It can be used in applications like a cigarette packet and like containers. This invention provides an advantageous feature of doubly securing the objects in the container.

BACKGROUND AND THE PRIOR ART

In a cigarette pack, to dispense a cigarette, the consumer has to tear-off the inner bundling and does not have the possibility of re-closing it automatically, leaving the remaining cigarettes exposed till the last consumption.

Some of the prior arts in the present field of invention are as under:

EP1590251 discloses a rigid package for tobacco articles has an outer first box having a top end opening; a second box inside the first box and having an end opening corresponding with the end opening of the first box; and an intermediate member interposed between the first and second box and fixed internally to one of the walls of the first box; the intermediate member surrounds the second box, and can assume at least two limit axial positions corresponding to two different positions of the second box, wherein a first portion of the intermediate member, defining a lid for closing the aforementioned openings, assumes respective positions opening and closing the openings.

EP2371739A1 discloses a cigarette packet substantially having the shape of a parallelepiped with a longitudinal axis comprises a first wrapper with an opening and a lid for closing the latter, and a second wrapper, inside the first wrapper, for surrounding a group of cigarettes and at its longitudinal end towards the lid having an opening for extracting the cigarettes; there being interposed between the first wrapper and the second wrapper a sliding element, able to move between a position in which it covers and a position in which it uncovers the opening of the second wrapper and the opening of the first wrapper.

While the prior art talks about different types of packaging arrangement for dispensing different objects they are subjected to certain drawbacks. One of said art provides for a first portion of the intermediate member, defining a lid for closing the aforementioned openings, that assumes respective positions opening and closing the openings. Other prior art provides a sliding element that is able to move between a position in which it covers and a position in which it uncovers the opening of the second wrapper and the opening of the first wrapper.

There is therefore a need for a packet that doubly secures the object inside a container. Also there is required a mechanism whereby after each dispensing the object remain doubly secured in the packet.

The automation of opening-closing as achieved in the proposed invention is technologically far more advanced and effective than a standard static bundling used in flip top boxes. The present invention therefore provides a packet for holding similar and/or dissimilar objects wherein said packet facilitates dispensing of objects when desired and reclosing to secure the said objects. It offers automatic opening and reclosing of the packet and thus the consumer does not have to keep his object exposed till the last one is consumed.

OBJECTS OF THE INVENTION

A basic object of the present invention is to overcome the disadvantages/drawbacks of the known art.

Another object of the present invention is to provide a packet for holding similar and/or dissimilar objects wherein said packet facilitates dispensing of objects when desired and reclosing to secure the said objects.

Another object of the present invention is to provide a packet for holding cigarettes wherein said packet facilitates dispensing of cigarettes when desired and reclosing to secure the cigarettes.

Another object of the present invention is to provide for doubly securing objects inside a packet.

Yet another object of the present invention is to provide a simple and cost effective arrangement for packaging.

These and other advantages of the present invention will become readily apparent from the following detailed description read in conjunction with the accompanying drawings.

SUMMARY OF THE INVENTION

The following presents a simplified summary of the invention in order to provide a basic understanding of some aspects of the invention. This summary is not an extensive overview of the present invention. It is not intended to identify the key/critical elements of the invention or to delineate the scope of the invention. Its sole purpose is to present some concept of the invention in a simplified form as a prelude to a more detailed description of the invention presented later.

In an aspect of the present invention, there is provided packet for holding similar and/or dissimilar objects wherein said packet facilitates dispensing of objects when desired and reclosing to secure the said objects, said packet comprising an outer container means defining a substantially rectangular box with its top side open to provide access to a closure means slidably secured inside the said container, said closure means having a lid means hingeably integrated to said closure means and comprising providing a user with a facility of pull-to-open action of the said closure means so as to substantially take out the closure means out of the said container and push-to-close action so as to secure the closure means inside the said container;

an internal container holding the said objects and providing accessibility to the said objects from the top of the internal container, said container located in the said closure means so that movement of the said internal container corresponds to the sliding movement of the said closure;

a bundling sleeve means running around the said internal container and substantially vertically about the vertical axis of said internal container and placed intermediately between said internal container and the outer container wherein said sleeve means rolls corresponding to the pulling action of the said closure;

wherein said bundling sleeve means defining plural panels whereby one of said panels comprising a cut out which during rolling action of the sleeve defining a dispensing site for the objects; and wherein said sleeve means comprising means to convert linear sliding motion of said internal container to rotational movement of the sleeve means;

wherein said internal container articulable with respect to said outer container keeping said sleeve means there between, and wherein said sleeve means configured to roll over on pulling said lid upwardly thereby revealing said cutout matching coextensively with said access opening of the internal container thus allowing the object to be dispensed and wherein relocating said lid means by push-to-close action back to its original position secure the said objects inside the internal container by relocating the cut out to its original position.

In another aspect of the present invention, there is provided a packet for holding cigarettes wherein said packet facilitates dispensing of cigarettes when desired and reclosing to secure the cigarettes, said packet comprising an outer container means defining a substantially rectangular box with its top side open to provide access to a closure means slidably secured inside the said container, said closure means having a lid means hingeably integrated to said closure means and comprising providing a user with a facility of pull-to-open action of the said closure means so as to substantially take out the closure means out of the said container and push-to-close action so as to secure the closure means inside the said container;

an internal container holding the said cigarettes and providing accessibility to the said cigarettes from the top of the internal container, said container located in the said closure means so that movement of the said internal container corresponds to the sliding movement of the said closure;

a bundling sleeve means running around the said internal container and substantially vertically about the vertical axis of said internal container and placed intermediately between said internal container and the outer container wherein said sleeve means rolls corresponding to the pulling action of the said closure;

wherein said bundling sleeve means defining plural panels whereby one of said panels comprising a cut out which during rolling action of the sleeve defining a dispensing site for the cigarettes; and wherein said sleeve means comprising means to convert linear sliding motion of said internal container to rotational movement of the sleeve means;

wherein said internal container articulable with respect to said outer container keeping said sleeve means there between, and wherein said sleeve means configured to roll over on pulling said lid upwardly thereby revealing said cutout matching coextensively with said access opening of the internal container thus allowing the object to be dispensed and wherein relocating said lid means by push-to-close action back to its original position secure the said cigarettes inside the internal container by relocating the cut out to its original position.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE ACCOMPANYING DRAWINGS

The following drawings are illustrative of particular examples for enabling methods of the present invention, are descriptive of some of the methods, and are not intended to limit the scope of the invention. The drawings are not to scale (unless so stated) and are intended for use in conjunction with the explanations in the following detailed description.

Figure 1:
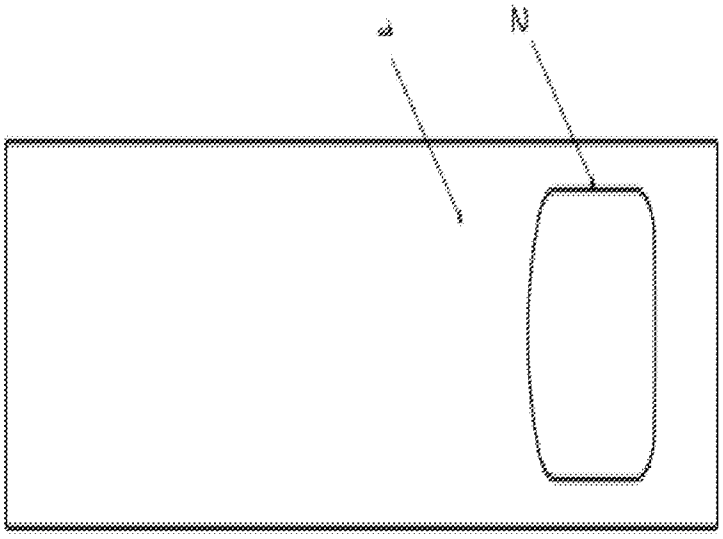
FIG. 1 illustrates drawing of the bundling sleeve means.

Persons skilled in the art will appreciate that elements in the figures are illustrated for simplicity and clarity and may have not been drawn to scale. For example, the dimensions of some of the elements in the figure may be exaggerated relative to other elements to help to improve understanding of various exemplary embodiments of the present disclosure.

Throughout the drawings, it should be noted that like reference numbers are used to depict the same or similar elements, features, and structures.

DETAILED DESCRIPTION OF THE INVENTION

The following description with reference to the accompanying drawings is provided to assist in a comprehensive understanding of exemplary aspects of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Accordingly, the present invention provides a packet for holding similar and/or dissimilar objects. This packet facilitates dispensing of objects when desired and reclosing it to secure the objects contained therein. Herein below the present invention is explained for dispensing similar and/or dissimilar objects e.g. cigarettes. In an exemplary embodiment, the present invention is explained for dispensing cigarettes. This should not be considered in any sense limiting the scope and spirit of the invention.

The packet comprises an outer container means defining a substantially rectangular box with its top side open to provide access to a closure means. The present invention can be applied to any shape of outer and inner boxes with cuboidal cross-sections with various edge/corner profiles like rounded, bevelled etc.

The closure means is slidably secured inside the said container. The closure means further comprises a lid means hingeably integrated to said closure means. The closure means provides a facility of pull-to-open action of the said closure means so as to substantially take out the closure means out of the said container. The sleeve means rotates in clockwise direction during pull-to-open action.

Further it provides for push-to-close action so as to secure the closure means inside the said container. The sleeve means rotates in anti-clockwise direction during push-to-close action.

Further, the packet comprises an internal container for holding objects/cigarettes. The top of the internal container facilitates accessibility to the said objects contained therein. The internal container is located in the closure means such that the movement of the said internal container corresponds to the sliding movement of the said closure.

There is provided a bundling sleeve means running around the said internal container and substantially vertically about the vertical axis of said internal container. Sleeve means is made selectively from metalized paper, foil, paperboard, plastics, metals and the like. It is placed intermediately between said internal container and the outer container on one side (as the front end of closure is open) and between said internal container and the closure means on the rear side. During operation this sleeve means rolls corresponding to the pulling action of the said closure means. Further, the bundling sleeve means comprises plural panels. One of said panels (panel 2) comprises a cut out thereon which during rolling action of the sleeve define a dispensing site for the objects. This cut out on articulation during object/cigarette dispensing is adapted to be spread sufficiently over the access opening of the internal container thereby forming the dispensing site. Panel 2 of this sleeve means is adapted to secure the objects inside the internal container.

It is pertinent to note that the sleeve means comprises a means to convert linear sliding motion of internal container to rotational movement of the sleeve means. Therefore internal container is articulable with respect to the outer container keeping said sleeve means there between. This means to convert linear sliding motion of said internal container to rotational movement of the sleeve means comprising a glued patch.

The Sleeve means is configured to roll over on pulling a lid upwardly thereby revealing said cutout matching coextensively with said access opening of the internal container thus allowing the object to be dispensed and wherein relocating said lid means by push-to-close action back to its original position secure the said objects inside the internal container by relocating the cut out to its original position.

The closure means have its front side open so as to expose said glued patch to the inside surface of the outer container. This closure means is releasably adhered to said outer container.

This dynamic mechanism as provided in the present invention provides a consumer the ability to internally reclose a pack of cigarettes after each usage. It facilitates to expose and enclose the access opening every time the cigarettes are dispensed. The proposed invention is for providing the consumers of cigarettes and the likes, opportunity to keep the cigarettes enclosed till the last cigarette is consumed.

Figure 2:
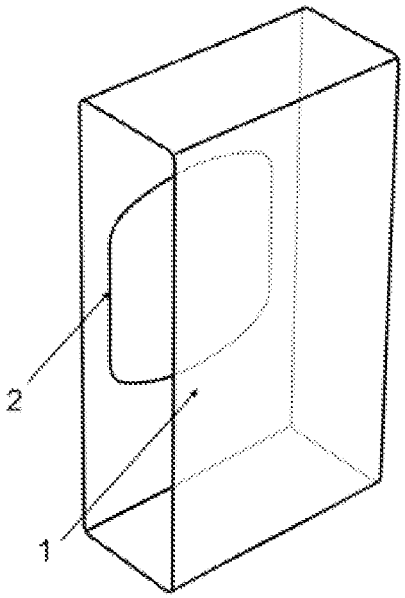
FIG. 2 illustrates bundling sleeve means in folded form.

As shown in FIG. 1, the bundling sleeve means, in a laminar sheet form has a cut out (2) for product dispensing. While the ends of the laminar sheet are joined together thereby forming a sleeve means with both sides opened where panel (1) and panel with cutout (2) create two opposite walls of the sleeve (FIG. 2).

Figure 3:
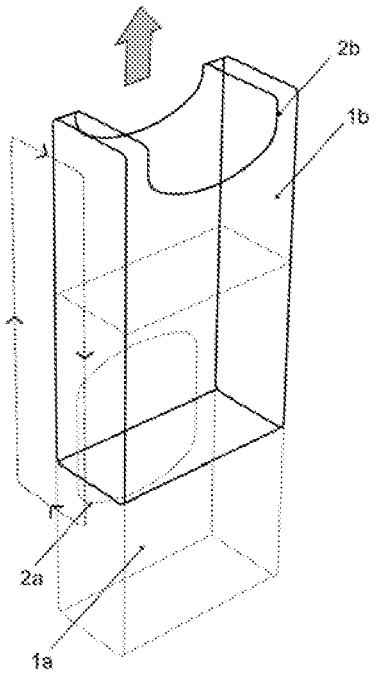
FIG. 3 illustrates rolling bundling movement of sleeve means.

FIG. 3 demonstrates the rolling bundling movement. Considering that the bundling sleeve means is put over an internal container and 1*a* and 2*a* are initial positions of facing panel and cutout on back panel respectively; with an upward movement of the inner container while holding the facing panel 1*a* fixed around a vertical center, the sleeve means rolls over the inner container clockwise to bring forth the cutout around the top (2*b*).

Figure 4:
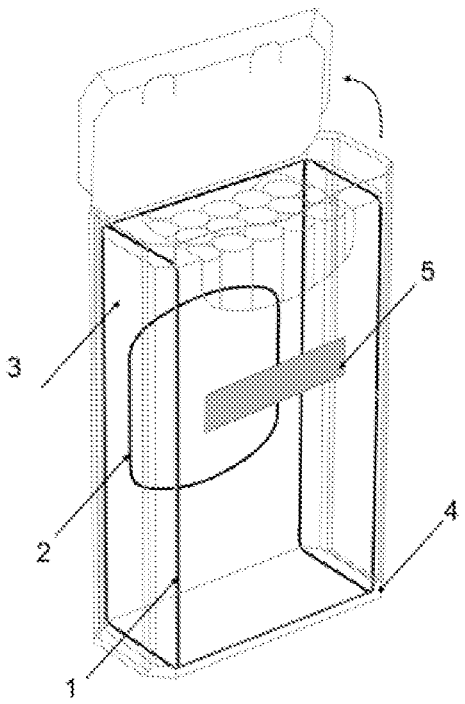
FIG. 4 illustrates bundling sleeve means in a packet.

FIG. 4 represents the placement of sleeve means within a pack. The pack has an internal container (3) which is articulable with respect to an outer container (4). The internal container contains the product and has an access opening spreading the top, front and back surfaces. The bundling sleeve means is placed over the internal container with vertical surface 1 facing the pack front and cutout (2) towards the back panel of the packet. Sleeve means is glued (5) to inside surface of the outer container.

Figure 5:
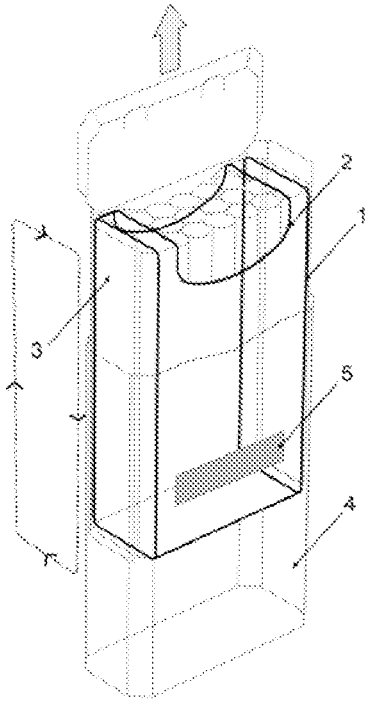
FIG. 5 illustrates rolling bundling movement in a packet.

As shown in FIG. 5, when the internal container (3) is moved upwards with respect to the outer container (4), the bundling sleeve also rolls around the inner container clockwise so that the cutout (2) on the bundling sleeve matches with the access opening on the inner container and product can be dispensed. The bundling only rolls around and does not move out with the inner container as it is glued (5) with the outer container. When the internal container is pushed back, the bundle sleeve rolls back anti-clockwise re-closing the access opening on the internal container.

Figure 6:
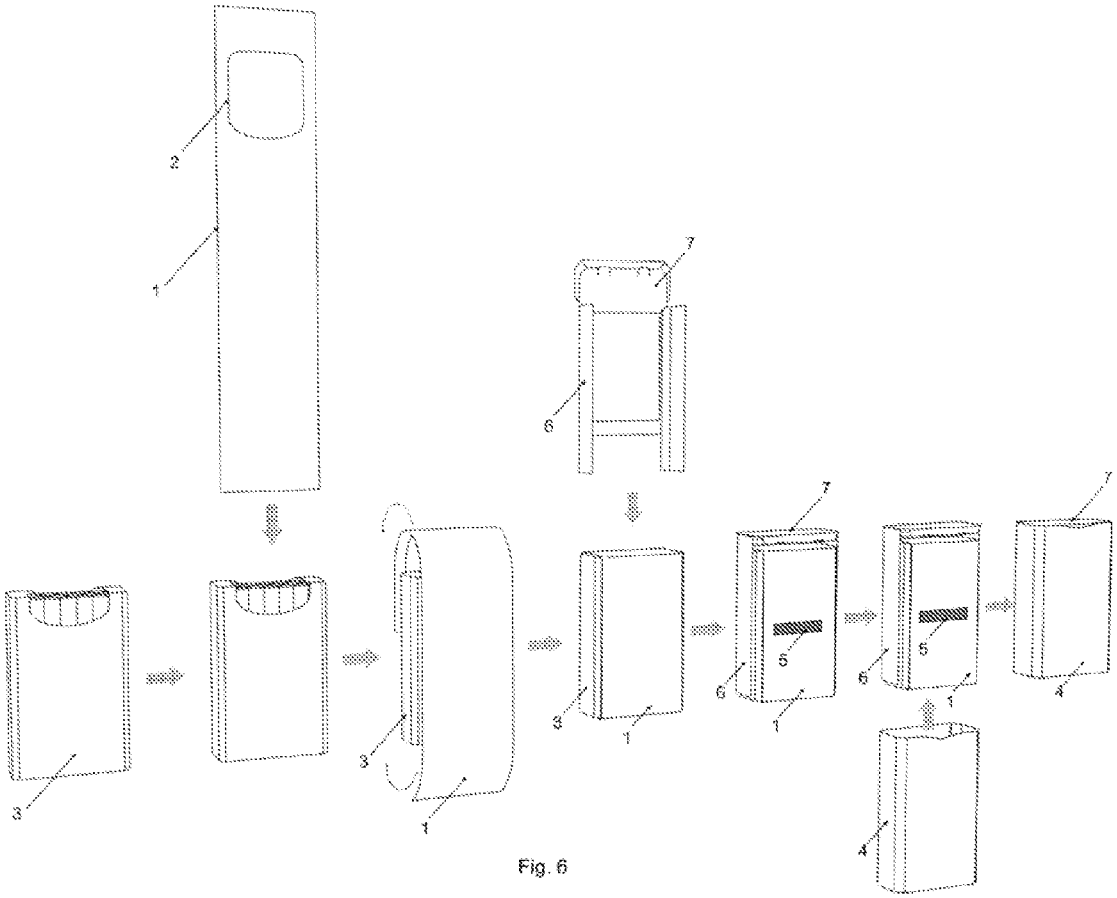
FIG. 6 illustrates embodiment to demonstrate the construction of the pack of the present invention.

As shown in FIG. 6, when an internal container (3) holding cigarettes is wrapped around along its vertical axis by a flexible bundling sleeve means (1).

Further, a closure means (6) having a lid means (7) hinged to itself is provided. This closure means is attached with the internal container (3) on the side panels keeping the bundling sleeve means (1) freely rotatable around the internal container (3) along its vertical axis.

The composite unit consisting of the internal container, bundling sleeve means and the closure means having a lid means is further inserted within the outer container (4) and the front panel of the bundling sleeve means is glued (5) to the inside front panel of the outer container (4).

Although the embodiments herein are described with various specific embodiments, it will be obvious for a person skilled in the art to practice the embodiments herein with modifications. However, all such modifications are deemed to be within the scope of the invention.

It is also to be understood that the description is intended to cover all of the generic and specific features of the embodiments described herein and all the statements of the scope of the embodiments which as a matter of language might be said to fall there between.

The invention claimed is:

1. A packet for holding similar and/or dissimilar objects, wherein the packet facilitates dispensing objects when desired and reclosing to secure the objects, the packet comprising:

an outer container defining a substantially rectangular box with its top side open to provide access to a closure slidably secured inside the outer container, the closure having a lid hingeably integrated to the closure to pull-to-open the closure so as to substantially take the closure out of the outer container and push-to-close action so as to secure the closure inside the outer container;

an internal container holding the objects and providing accessibility to the objects from the top of the internal container, the internal container located in the closure so that movement of the internal container corresponds to the sliding movement of the closure;

a bundling sleeve running around the internal container and substantially vertically about the vertical axis of the internal container and placed intermediately between the internal container and the outer container wherein the sleeve rolls corresponding to the pulling action of the closure;

wherein the bundling sleeve defines a plurality of panels; one of the panels comprising a cut out which during rolling action of the sleeve defines a dispensing site for the objects; and the sleeve converts linear sliding motion of the internal container to rotational movement of the sleeve;

wherein the internal container is articulable with respect to the outer container keeping the sleeve there between, and the sleeve is configured to roll over on pulling the lid upwardly and substantially taking out the closure with the internal container thereby revealing the cutout matching coextensively with the access opening of the internal container, thus allowing the object to be dispensed; and wherein relocating the lid by push-to-close action back to its original position secures said objects inside the internal container by relocating the cut out to its original position;

wherein converting linear sliding motion of the internal container to rotational movement of the sleeve employs a glued patch; and wherein the closure has a front side open so as to expose the glued patch to an inside surface of the outer container.

2. The packet of claim 1, wherein the sleeve comprises metalized paper, foil, paperboard, plastic, or metal.

3. The packet of claim 1, wherein the sleeve comprises two panels.

4. The packet of claim 3, wherein one of the panels of the sleeve being adapted to secure the objects inside the internal container.

5. The packet of claim 4, the other panel comprising the cut out.

6. The packet of claim 1, wherein the cut out, on articulation during object dispensing, is adapted to be spread sufficiently over the access opening of the internal container to define the dispensing site.

7. The packet of claim 1, wherein the sleeve rotates in a clockwise direction during pull-to-open action.

8. The packet of claim 1, wherein the closure is releasably adhered to the outer container.

9. A packet for holding cigarettes, wherein the packet facilitates dispensing of cigarettes when desired and reclosing to secure the cigarettes, the packet comprising:

an outer container defining a substantially rectangular box with its top side open to provide access to a closure slidably secured inside the outer container, the closure having a lid hingeably integrated to the closure to pull-to-open the closure so as to substantially take the closure out of the container and push-to-close action so as to secure the closure inside the container;

an internal container holding the cigarettes and providing accessibility to the cigarettes from the top of the internal container, the internal container located in the closure so that movement of the internal container corresponds to the sliding movement of the closure;

a bundling sleeve running around the internal container and substantially vertically about the vertical axis of the internal container and placed intermediately between the internal container and the outer container wherein the sleeve rolls upon pulling action of the closure;

wherein the bundling sleeve defines a plurality of panels, one of the panels comprising a cut out which during rolling action of the sleeve defines a dispensing site for a cigarette; and the sleeve being configured to convert linear sliding motion of the internal container to rotational movement of the sleeve;

the internal container is articulable with respect to the outer container keeping the sleeve there between, and the sleeve is configured to roll over on pulling the lid upwardly and substantially taking out the closure with the internal container and revealing said cutout matching coextensively with the access opening of the internal container, thus allowing the cigarette to be dispensed, and relocating the lid by push-to-close action back to its original position secures the cigarettes inside the internal container by relocating the cut out to its original position;

wherein converting linear sliding motion of said internal container to rotational movement of the sleeve employs a glued patch; and wherein the closure has a front side open so as to expose said glued patch to an inside surface of the outer container.

10. The packet of claim 9, wherein the sleeve comprises metalized paper, foil, paperboard, plastic, or metal.

11. The packet of claim 9, wherein the sleeve comprises two panels.

12. The packet of claim 11, wherein one of the panels is adapted to secure the cigarettes inside the internal container.

13. The packet of claim 12, wherein the other panel comprises the cut out.

14. The packet of claim 9, wherein the cut out, on articulation during cigarette dispensing, is adapted to be spread sufficiently over the access opening of the internal container to define the dispensing site.

15. The packet of claim 9, wherein the sleeve rotates in a clockwise direction during pull-to-open action.

16. The packet of claim 9, wherein the sleeve rotates in an anti-clockwise direction during push-to-close action.

17. The packet of claim 9, wherein the closure is releasably adhered to the outer container.

* * * * *